US005114142A

United States Patent [19]

Gillespie et al.

[11] Patent Number: 5,114,142

[45] Date of Patent: May 19, 1992

[54] TRAINING DEVICE FOR BASEBALL HITTERS

[76] Inventors: Gordon A. Gillespie, 508 North William St.; Joseph A. Delgado, 817 Hobbs Dr., both of Joliet, Ill. 60435

[21] Appl. No.: 25,219

[22] Filed: Mar. 12, 1987

Related U.S. Application Data

[63] Continuation of Ser. No. 588,160, Mar. 12, 1984, abandoned.

[51] Int. Cl.[5] ..... A63B 71/00

[52] U.S. Cl. ..... 273/26 C; 273/29 A; 273/189 R

[58] Field of Search ..... 273/189 R, 188, 190, 273/193 B, 26 R, 29 A; 128/134

[56] References Cited

U.S. PATENT DOCUMENTS 114,615 5/1871 Smittey ..... 128/94
3,515,131 6/1970 Stevens ..... 128/94
3,780,729 12/1973 Garnette ..... 128/94
3,970,316 7/1976 Westmoreland, Jr. ..... 273/189 R

*Primary Examiner*—Theatrice Brown
*Attorney, Agent, or Firm*—John L. Parker

[57] ABSTRACT

A training device for baseball or softball hitters is provided having a firm belt for encircling the chest of a hitter, and a separate firm belt for encircling the upper portion of the lead arm of the hitter, with the two belts being firmly secured together so as to bind the hitter's upper lead arm tightly to his side while leaving his forearm generally free for movement throughout an entire swing of the bat. Using this training device, when the hitter begins to swing at a pitched ball, the upper portion of his lead arm and elbow becomes "locked in" close to his side, and remains so locked throughout the entire swing. The training device thus promotes desirable hip action and "tophand action" produced by the swinging motion of the hitter's body, thus generating more power in the swing.

2 Claims, 2 Drawing Sheets

TRAINING DEVICE FOR BASEBALL HITTERS

This application is a continuation of the applicants' application Ser. No. 588,160, filed Mar. 12, 1984 (now abandoned).

DESCRIPTION OF THE INVENTION

This invention relates generally to training devices for baseball or softball hitters, and more particularly to such devices for improving the mechanics of hitting a baseball or softball.

A baseball (or softball) batter typically stands sidewise in a batter's box, with his lead arm and elbow (i.e., the arm and elbow on the side toward the pitcher) poised and his rear arm and shoulder (i.e., the arm and shoulder on the side away from the pitcher) cocked in readiness for the pitch. For best results, the bat should be swung in a plane that is horizontal, or tilted slightly downwardly from the horizontal as the bat passes over the plate. This results in "tophand" action, i.e., the bat chops slightly downwardly on the ball, which generates more power in the swing. Such desirable batting action may be accomplished, however, only if the batter's lead arm and elbow are properly positioned at all times, and if the batter correspondingly maintains his rear arm and shoulder so as to effectuate proper shifting of his hips and body during the swing.

Many people begin playing baseball at an early age without formal instruction as to proper batting technique. As a result, they often develop bad habits which are difficult to break. This is especially true of the baseball swing, which most people develop without sufficient thought or regard for the fundamentals (as stated, proper positioning of the lead arm and elbow, and resultant proper shifting of the body and hips with the swing).

For example, one of the most common faults of a baseball swing is that known as "chicken winging". This occurs when the batter allows his lead arm and elbow to move up and away from his side before and during the swing. A high lead arm and elbow makes it difficult for the player to bring the bat around his body in time to hit an inside pitch that is in the strike zone. Such high lead arm action is also usually accompanied by the player dropping his rear shoulder, resulting in an undesirable uppercut type of swing which usually misses the ball. Most of the missed swings in baseball are of this type, the bat cutting upwardly underneath the ball.

It is a primary object of the invention to provide a training device for baseball (or softball) hitters which teaches or improves the mechanics of batting or hitting the ball. A related object is to provide such a training device to be worn by a baseball batter during pre-game batting drills, for example for use with batting tees, during flip-ball drills, hitting from pitching machines and in live batting practices. A related object of this invention is to provide such a training device for correcting faults which often become a part of a baseball swing. Still another object of the invention is to provide a training device for imparting to an experienced baseball hitter constant reinforcement of what he has learned about the basic mechanics of the swing. Still another object of the invention is to provide such a training device which prevents a baseball hitter from developing an undesirable uppercut type swing.

It is also an object of the invention to provide a training device which assures that the batter's lead arm and elbow are "locked in" at his side so that proper lead arm action results, thus producing fast and powerful bat action from the beginning through the end of the swing. A further object of the invention is to provide a training device for baseball hitters which insures proper follow-through and finishing position in the swing. Moreover, it is an object of the invention to provide a training device which results in the hitter maintaining proper body balance throughout the swing, with the result that the ball is squarely hit and is hit more often.

Still another object of the invention is to provide such a training device which is easily used by a player, and which may be used interchangeably for right-handed or left-handed hitters (the device need simply be turned around).

Yet another object of the invention is to provide such a training device which is light in weight, and is readily foldable into a compact package and thus easily transportable along with other baseball accessories.

Other objects and advantages of the invention will become apparent to those skilled in the art from the drawings and description.

In the drawings, FIG. 1 is a front, vertical, elevational view showing a baseball player or hitter wearing the illustrative training device of the invention around his chest and one arm (as shown, player bats left-handed). FIG. 2 is a rear, vertical, elevational view of the hitter shown in FIG. 1.

While the invention will be described in connection with certain preferred embodiments, it will be understood that we do not intend to limit the invention to those embodiments. On the contrary, we intend to cover all alternatives, modifications and equivalents as may be included within the spirit and scope of the invention.

Figure 1:
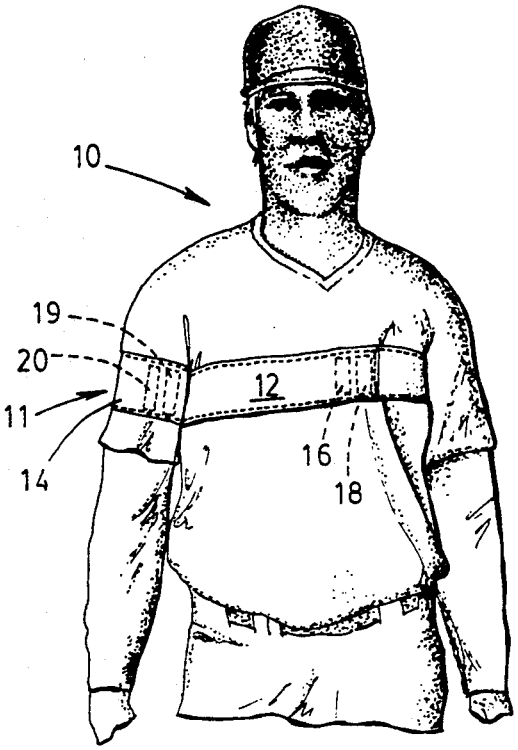
Figure 2:
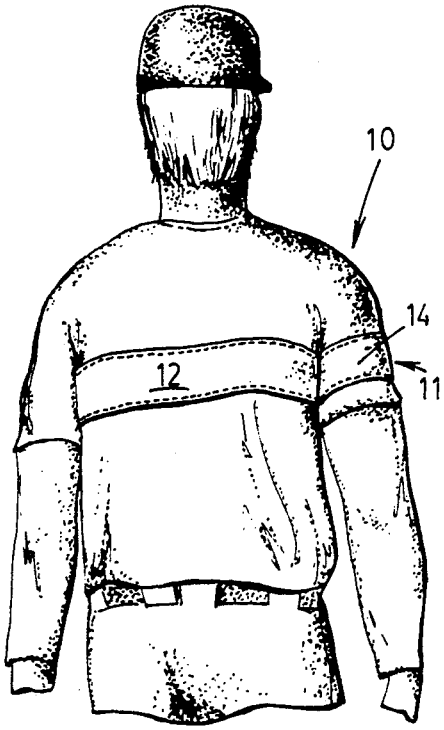
Figure 5:
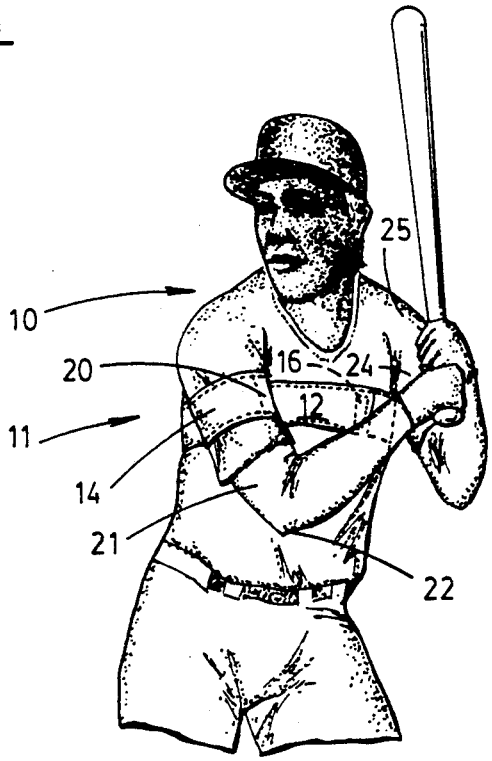
FIG. 5 is a perspective view of the baseball hitter of FIGS. 1 and 2, with baseball bat in hand, showing the manner in which the illustrative training device of the invention appears on the hitter during swinging of the bat.

Turning now to the drawings, an exemplary baseball player 10 is shown in FIGS. 1, 2 and 5, having an illustrative training device 11 of the invention secured to his upper torso. As illustrated, the training device 11 comprises a firm chest belt 12, and a firm upper arm belt 14, with the two belts being firmly fastened together by stitching 15 or other appropriate means. As shown, the chest belt 12 is provided at its ends with "Velcro" type fasteners 16, 18 which facilitate its being snugly and securely fastened around the player's chest. Likewise, the upper arm belt 14 may be provided with "Velcro" type fasteners 19, 20 so that it may be similarly fixed around the upper arm of the player. The exemplary player in the drawings is shown batting left-handed. Thus, the upper arm belt 14 is placed around the player's right or lead arm 21 above the elbow 22, i.e., on the side toward the pitcher as the batter stands ready in the batter's box (also see FIG. 5). The player's rear arm 24 and shoulder 25 are those located on the side away from the pitcher. As shown in the drawings, the "Velcro" fasteners 16, 18 on the chest belt 12 are arranged to fasten in the front of the player to facilitate the player putting on and removing the training device. Likewise, the fasteners 19, 20 on the arm belt are arranged to fasten on the outside of the arm for ready access. The upper arm belt 14 should run fairly straight around the hitter's upper arm, as should the chest belt 12 around his chest. Therefore, these belts should be of sufficient width to fit comfortably around the upper arm and chest, without sliding or riding up with the motion of the arm during the swing. The belts 12 and 14 may be formed of vinyl or other firm, inelastic material so that they are fully functional and yet may be worn snugly yet comfortably for fairly long periods of time.

Figure 3:
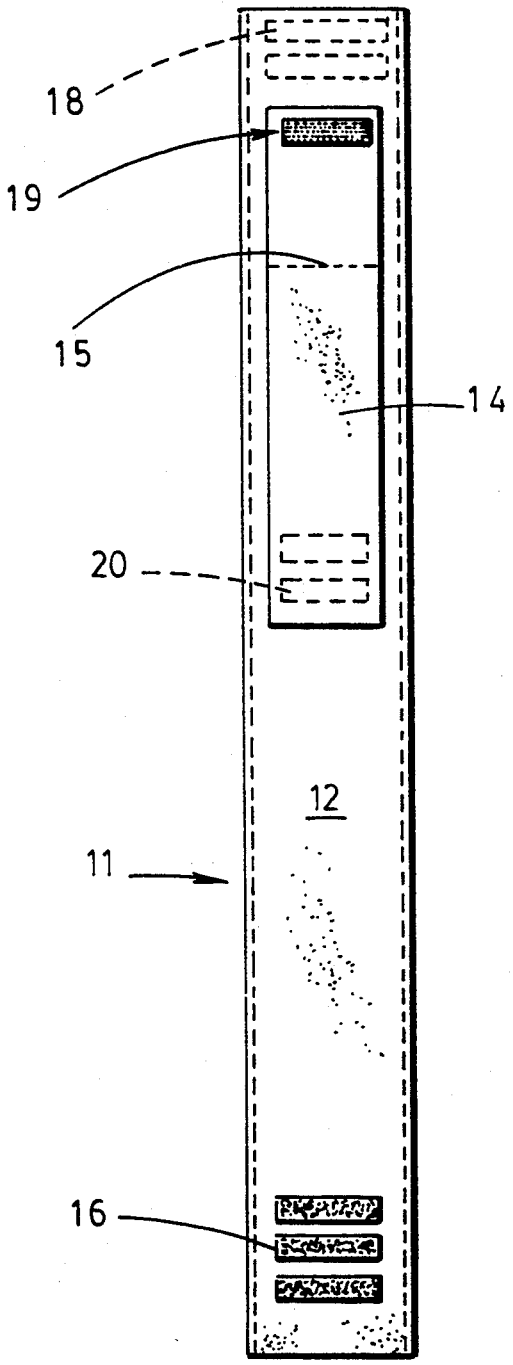
FIGS. 3 and 4 are front and rear plan views, respectively, of the illustrative training device of the invention, showing the device in a fully opened or flat position prior to being worn by a baseball hitter.
Figure 4:
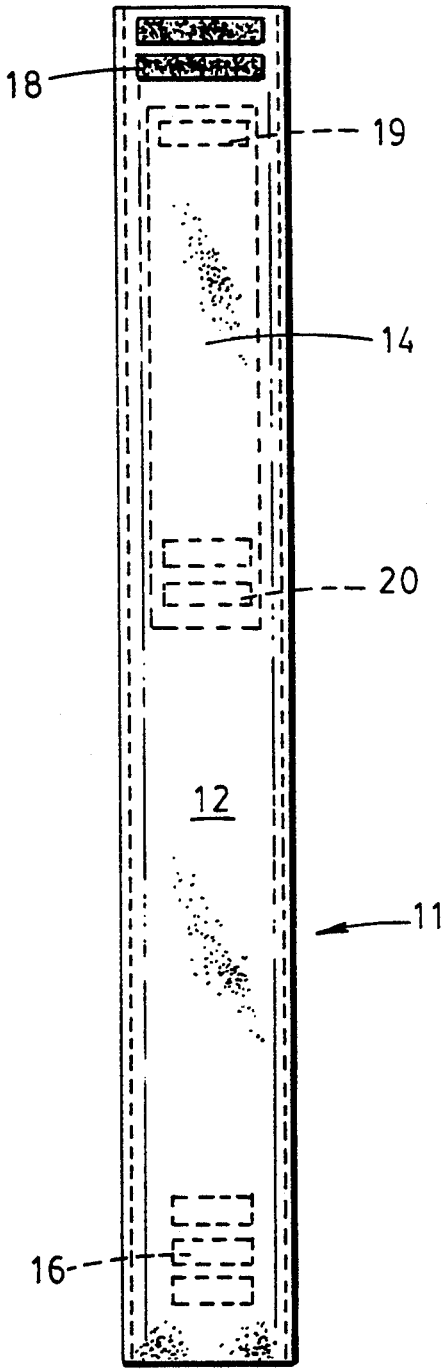

The details of the illustrative chest belt 12 and upper arm belt 14 are shown in FIGS. 3 and 4. As shown there, the upper arm belt is somewhat narrower than the chest belt (although this need not be the case), and as indicated, the two belts are firmly secured to each other, for example by stitching as at 15. The stitch line or fastening seam is positioned so as to be located directly under the armpit of the player to provide a rigid or firm brace forcing the player's lead arm 21 to be held tightly to his side. In some situations, it may be preferred for the arm belt 14 to be of approximately the same width as the chest belt 12 (for example, as shown in FIGS. 1, 2 and 5).

In carrying out the invention, the firm chest belt 12 and the firm upper arm belt 14 tightly secured thereto, with the belts in direct contact with each other, functions as a rigid brace to bind the hitter's lead upper arm 14 to his side as he stands in the batter's box. When the hitter starts to swing at the ball, his lead elbow 22 becomes "locked in" close to his side above the hip, forcing him to use fast and compact lead arm action of the bat, and encouraging proper hip action and tophand action produced mostly by the rear arm 24 thus generating more power in the swing. Note that while the upper portion of the lead arm 21 is held close to the player's upper body, this is accomplished without interfering with the movement of the player's forearm relative to his body.

Once a baseball hitter has his arms and bat set, awaiting the pitch, it is important that the upper portion of his lead arm not move in relation to his chest or side throughout the approach to the ball, through contacting of the ball, and through the two-handed follow-through of the arms and bat after the ball has been hit. In other words, our device functions in an important manner throughout the entire swing of the bat.

In some respects, the training device of our invention may be considered to function as a vest or somewhat like a harness. Unlike a true vest, however, our device is preferably not worn beneath outer clothing. In any event, our device may be considered to have some of the functions that would be attendant to certain types of vest or harness.

Of course, the training device of our invention is meant to be used exclusively for hitting training or practices. It is not usually appropriate to use this device in the actual playing of a baseball game, because by its very restrictive nature, the device might so seriously impede motion of the upper body of the player that the player could not, for example, run the bases as fast as if he were not wearing the device.

It will thus be seen that the training device of the present invention is especially designed and constructed to provide and teach proper swing fundamentals by locking the lead arm in at the player's side to insure good lead arm action and proper hip action in generating fast bat action and power throughout the entire swing. Locking in of the lead arm prevents a "high" lead elbow, which would produce an undesirable sweeping type swing and an inability to get the hitting surface of the bat around in time to hit an inside pitch. Our training device is also designed to keep the player's lead shoulder and head in at all times, driving at the pitch. Our training device keeps the lead elbow low to generate the highest bat speed possible, and to keep the player's hips in position to properly pivot which is essential to the generation of batting power.

Our invention thus advantageously keeps the batter's hands close to the center of gravity of his body, thereby producing more power in his swing. At the same time, the invention avoids undesirable uppercutting of the bat by eliminating "high" lead arm action at the start of, and during, the swing.

It is found, moreover, that the training device of our invention insures proper follow-through and finishing position in the swing. Thus, the player's head desirably stays positioned over his back leg throughout the entire swing, so that follow-through and completion of the swing end with the bat secure in the player's hands and with the hand of the player's rear arm touching the hitter's lead arm 21 approximately three inches below the shoulder area. The hitter thus maintains proper balance, and desirably avoids moving his back foot forward to gain balance that he lost on the swing.

Use of the training device of the invention also insures proper body action on attacking low pitches over the inside of the plate. For example, to hit a low inside pitch properly, the hitter must drop his center of gravity (especially the back leg) down in order to reach for and get the pitch. While wearing our training device, the hitter is forced to go down and hit the ball properly.

Utilizing our invention, the hitter is trained to keep his lead arm 21 and elbow 22 tucked in tightly to his side at all times during swing of the bat. Thus, when the hitter begins his swing with his lead elbow securely held "locked in" along and adjacent to his hip, assurance is given that proper pivoting of the hitter's hips will be achieved as the bat passes over the plate.

We claim as our invention:

1. A training device for baseball hitters using a bat comprising, in combination, (a firm) an inelastic belt for encircling the chest of a hitter, a second (firm) inelastic belt for encircling the upper portion of the lead arm of the hitter, and means for firmly securing said chest and arm belts together in direct contact with each other to thereby bind the hitter's upper lead arm and elbow tightly to his side while leaving his forearm generally free for movement throughout an entire swing of the bat.

2. A training device as defined in claim 1 in which the means for firmly securing the chest and arm belts together is located directly under the armpit of the hitter when the device is being worn by a hitter.

* * * * *